United States Patent [19]

Hamai et al.

[11] Patent Number: 4,502,454

[45] Date of Patent: Mar. 5, 1985

[54] IGNITION SYSTEM FOR AN INTERNAL COMBUSTION ENGINE

[75] Inventors: Kyugo Hamai; Meroji Nakai, both of Yokosuka; Ryusaburo Inoue, Yokohama; Yasuhiko Nakagawa, Kamakura, all of Japan

[73] Assignee: Nissan Motor Company, Limited, Japan

[21] Appl. No.: 393,083

[22] Filed: Jun. 28, 1982

[30] Foreign Application Priority Data

Jul. 3, 1981 [JP] Japan ..... 56-103220
Jul. 3, 1981 [JP] Japan ..... 56-103221
Jul. 3, 1981 [JP] Japan ..... 56-103222

[51] Int. Cl.[3] ..... F02P 9/00

[52] U.S. Cl. ..... 123/597; 123/598; 123/625; 123/634; 123/635; 123/643; 123/417

[58] Field of Search ..... 123/596, 597, 598, 605, 123/625, 634, 635, 643, 416, 417, 425, 640

[56] References Cited

U.S. PATENT DOCUMENTS

| | | | |
|---|---|---|---|
| 1,011,884 | 12/1911 | Cavanagh | 123/634 |
| 2,394,768 | 2/1946 | Harkness | 123/635 |
| 2,784,349 | 3/1957 | Anderson | 315/176 |
| 2,975,331 | 3/1961 | Diaz et al. | 315/163 |
| 3,334,270 | 8/1967 | Nuckolls | 315/171 |
| 3,554,177 | 1/1971 | Hufton et al. | 123/407 |
| 3,605,714 | 9/1971 | Hardin et al. | 123/598 |
| 3,621,826 | 11/1971 | Chrèstensen | 123/643 |
| 3,716,038 | 2/1973 | Bevacqua | 123/634 |
| 3,903,856 | 9/1975 | McDougal et al. | 123/643 |
| 4,033,316 | 4/1977 | Birchenough | 123/148 E |
| 4,136,301 | 1/1979 | Shimojo et al. | 315/209 T |
| 4,170,207 | 10/1979 | Boyama | 123/602 |
| 4,191,912 | 3/1980 | Gerry | 315/209 R |
| 4,223,656 | 9/1980 | Hamley | 123/597 |
| 4,258,683 | 3/1981 | Hattori et al. | 123/416 |
| 4,359,037 | 11/1982 | Stangl | 123/643 |
| 4,366,801 | 1/1983 | Endo et al. | 123/596 |
| 4,367,531 | 1/1983 | Furuhashi et al. | 123/416 |

FOREIGN PATENT DOCUMENTS

| | | |
|---|---|---|
| 1170151 | 11/1969 | United Kingdom . |
| 1465839 | 3/1977 | United Kingdom . |

*Primary Examiner*—Andrew M. Dolinar
*Attorney, Agent, or Firm*—Lowe, King, Price & Becker

[57] ABSTRACT

An ignition system for a multi-cylinder internal combustion engine eliminates high-voltage cables and a mechanical distributor in order to reduce electrical power losses due to joule effect caused mainly by the high voltage circuit, comprises a plurality of ignition coils and plugs, one provided for each cylinder, a distribution unit for distributing advance-angle control signals into the respective cylinders, and a booster for boosting the supply voltage in order to reduce the size of the ignition coil, in addition to the conventional ignition system. Furthermore, the ignition coil can be built integrally with the ignition plug for eliminating high-voltage cables connected between coil and plug.

25 Claims, 20 Drawing Figures

IGNITION SYSTEM FOR AN INTERNAL COMBUSTION ENGINE

BACKGROUND OF THE INVENTION

1. Field of the Invention

The present invention relates generally to an ignition system for an internal combustion engine, and more particularly to an ignition system in which electrical power losses due to high-voltage lines to and from an ignition distributor are eliminated because the ignition system does not include high voltage lines connected to an ignition distributor.

2. Description of the Prior Art

As is well known, a typical prior-art ignition system for a multi-cylinder internal combustion engine comprises an electromagnetic pulse generator for clocking and directing ignition timing for each cylinder, an ignition advance-angle control unit for controlling advance angle in accordance with engine speed and intake vacuum pressure, an ignition unit for generating switching signals in response to the signals from the ignition advance-angle control unit, a power transistor for turning the primary current of an ignition coil on and off in response to the switching signals. In addition to these elements, in order to distribute the high voltage generated in a secondary winding of the ignition coil, the prior-art ignition system usually comprises a center cable, a distributor, and a number of high-voltage cables, in order to distribute ignition energy to the ignition plug for each cylinder.

In the prior-art ignition system, however, the power loss is very large due to joule effect losses, i.e. $I^2$ power losses, in the center cable, high-voltage cables and spark loss between a rotor and electrodes of the distributor that is, power consumption is great and therefore the efficiency of energy conversion is very low, thus unnecessarily increasing power consumption or fuel consumption rate.

The prior-art ignition system will be described in more detail hereinafter with reference to the attached drawings under DETAILED DESCRIPTION OF THE PREFERRED EMBODIMENTS.

SUMMARY OF THE INVENTION

With these problems in mind therefore, it is the primary object of the present invention to provide an internal combustion engine ignition which minimizes electrical power losses due to high-voltage cables and ignition distributor elements.

In order to achieve the above mentioned object, the ignition system according to the present invention eliminates the use of a high-voltage center cable, high-voltage cables, and a mechanical distributor in order to reduce the joule effect losses in the high-voltage circuit. To this end, the system comprises a distributing unit for distributing advance-angle control signals generated by an advance-angle control unit for each cylinder, a plurality of switching units turned on and off in response to the switching control signals from the distributing unit, a plurality of ignition coils and a plurality of ignition plugs.

Additionally, a supply voltage booster reduces the size of the ignition coils.

Furthermore, in this invention, the amount of ignition energy is controlled according to the engine operating condition by adjusting the boosted voltage, which is supplied to ignition energy condensers, in such a way that the ignition energy is increased when the engine operates at relatively low speed such as during engine starting, idling or light-load engine running in steady operation. Therefore, a leaner mixture can be securely ignited without inducing misfire.

Finally, in this invention, since the ignition plug coil is disposed within a housing of the ignition plug unit, the high-voltage terminal of the ignition coil can be directly connected to the central electrode of the ignition plug, thus obviating the need for an intermediate high-voltage cable.

Therefore, in the ignition system according to the present invention, neither high-voltage cables nor a mechanical distributor is required, and magnetic dispersion losses from the ignition coil are reduced, so that overall electrical power efficiency in the ignition system is improved.

BRIEF DESCRIPTION OF THE DRAWINGS

The features and advantages of the ignition system for an internal combustion engine according to the present invention over the prior-art ignition system will be more clearly appreciated from the following description of the preferred embodiments of the invention taken in conjunction with the accompanying drawings in which like reference numerals designate the same or similar elements or units throughout the figures thereof and in which.

DETAILED DESCRIPTION OF THE PREFERRED EMBODIMENTS

To facilitate understanding of the present invention, brief reference will be made to a prior-art ignition system for an internal combustion engine, with reference to the attached drawings.

Figure 1:
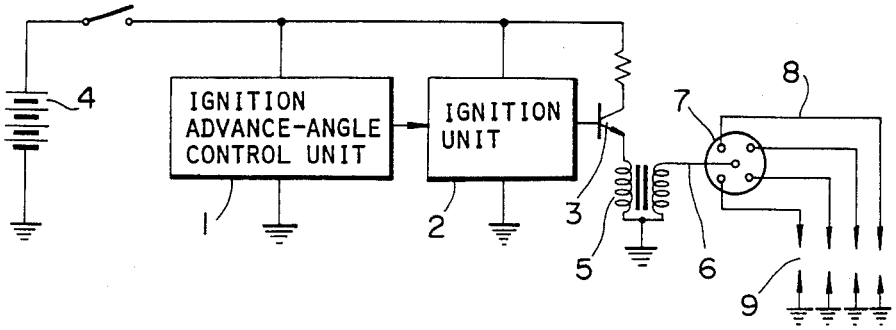
FIG.1 PRIOR ART
FIG. 1 is a schematic block diagram of a first exemplary prior-art ignition system for an internal combustion engine.

FIG. 1 is a block diagram of first exemplary prior-art ignition system made up largely of transistors. In the figure, an electromagnetic pulse generator (not shown) clocks the respective ignition timings for each cylinder; an ignition advance-angle control unit 1 determines ignition advance angle in accordance with engine speed and intake vacuum pressure; in response to the signals from the advance-angle control unit 1, an ignition unit 2 produces a switching control signal indicating an appropriate dwell angle according to the current engine speed; in response to the signals from the ignition unit 2, a power transistor 3 is turned on and off so as to intermittently transmit a supply voltage from a battery 4 to the primary coil of the ignition coil 5; the high-voltage generated by the secondary coil of the ignition coil 5 is fed to a distributor 7 via a center cable 6; the ignition energy is distributed through the distributor 7 to the ignition plug 9 of each cylinder via high-voltage cables 8. The center cable 6 and the high-voltage cables 8 are formed as a high-resistance conduction medium in which carbon powder is mixed with glass fiber to attenuate high-frequency due to the spark generated by the distributor 7 that is, to prevent electromagnetic wave interference.

In this exemplary prior-art system, due to large power losses in the center cable 6 and the high-voltage cables 8 and the spark generated between the rotor of the distributor 7 and the electrodes on the surface thereof, only ten percent of the power supplied to the ignition system leaves the system as ignition energy. That is to say, if a current of 5A is supplied to the ignition system while a vehicle is travelling, a current of as much as 4.5A may be dispersed as heat loss. Thus for a cruising vehicle, the fuel efficiency may decrease by 0.1 km/l whenever the current increases 1A.

Figure 2:
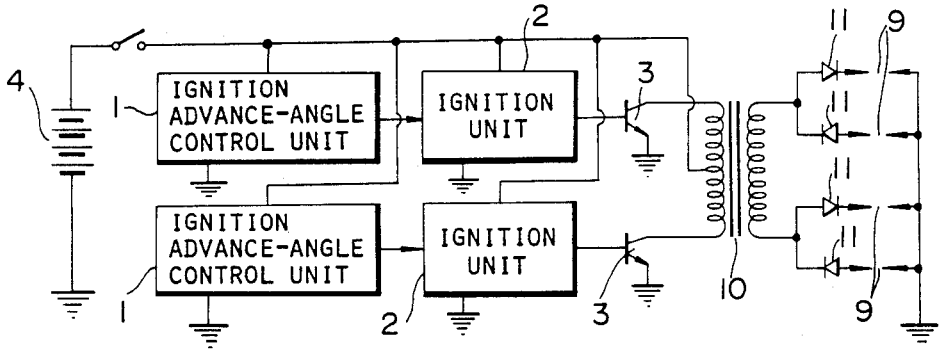
FIG.2 PRIOR ART
FIG. 2 is a schematic block diagram of a second exemplary prior-art ignition system for an internal combustion engine.

FIG. 2 is a block diagram of a second exemplary prior-art distributor-less ignition system of the Haltig type. In this system, each of two identical, parallel systems includes an ignition advance-angle control unit 1, an ignition unit 2 and a power transistor 3; the power transistors 3 pass the primary current of the ignition coil 10 alternate in opposite directions; two pairs of anti-parallel oriented high-voltage diodes 11 are connected at opposite ends of the secondary of the ignition coil 10; the ignition energy is simultaneously generated for two cylinders, each in two strokes of compression and exhaustion. In this system, electrical power loss is reduced, as compared with the first exemplary prior-art system shown in FIG. 1, because the center cable and the distributor are not required; however, since two cylinders are simultaneously ignited, the ignition energy consumed in the exhaust stroke is almost equivalent to the power loss which would otherwise be due to the distributor. Therefore, it is possible to prevent only that power loss due to the center cable.

As described above, in the prior-art ignition systems, power consumption is large and the efficiency of energy conversion is low. In other words, insufficient consideration has been given so far to improvement in fuel consumption rate or in power consumption.

Thus, from the standpoint of power consumption, almost all parts of the power loss in the prior-art ignition system are caused by the center cable and the high-voltage cables and the spark generated in the mechanical distributor, as described above. Therefore, if it were possible to eliminate these causes of energy losses, only half or less of the power supplied to a prior-art ignition system would be sufficient to obtain the same ignition energy, and it would be possible to improve the fuel consumption rate markedly.

In view of the above description, reference is now made to embodiments of the ignition system for an internal combustion engine according to the present invention, with reference to the attached drawings.

Figure 3:
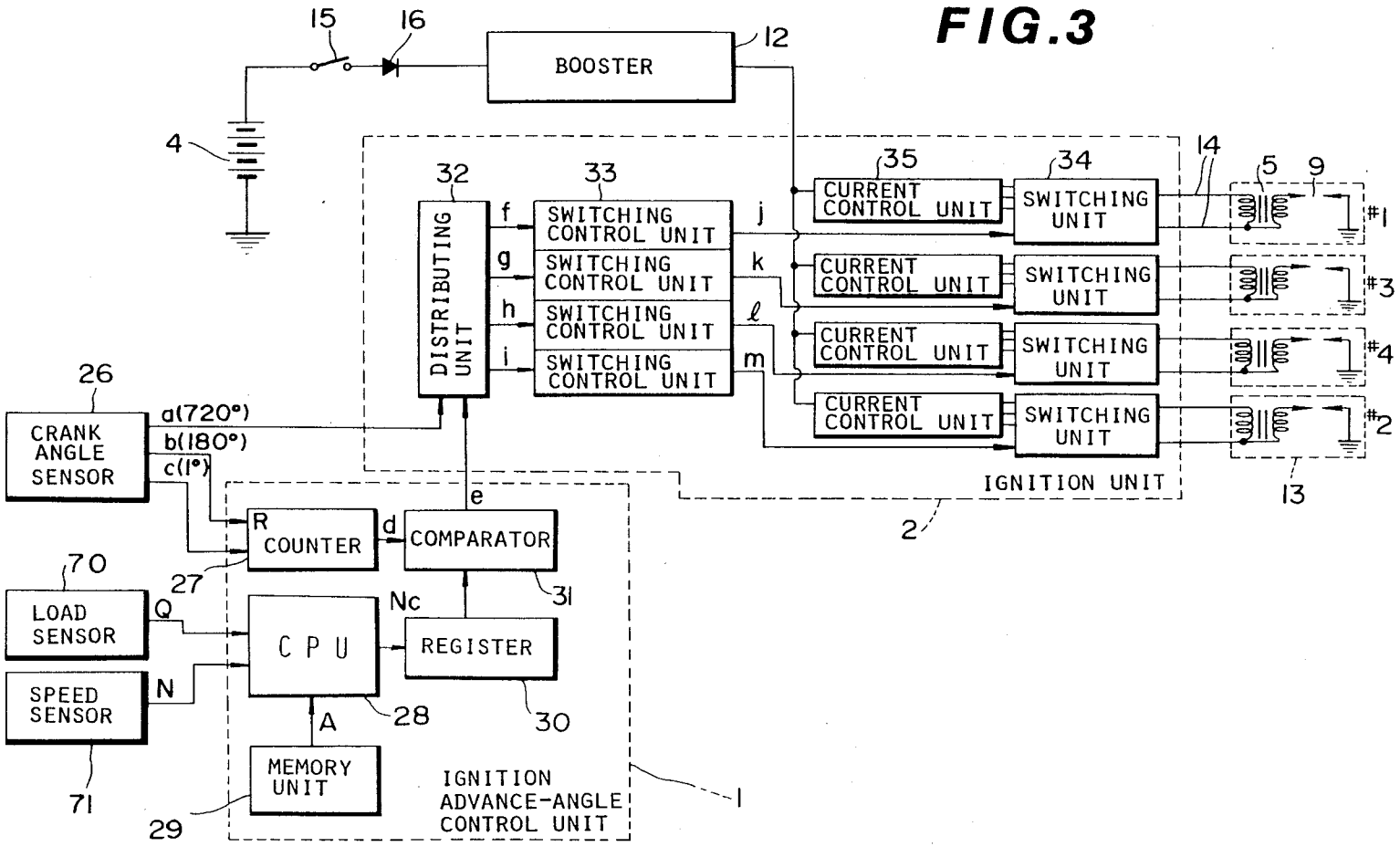
FIG. 3 is a schematic block diagram of a first embodiment of the ignition system for an internal combustion engine according to the present invention.

FIG. 3 is a schematic block diagram of a first embodiment of the ignition system for a four-cylinder internal combustion engine according to the present invention. The ignition system shown in FIG. 3 mainly comprises: (1) an ignition advance-angle control unit 1 for determining the ignition timing of each cylinder and for generating ignition timing signals indicative of an advance angle controlled in accordance with detected engine speed and engine load; (2) an ignition unit 2 for distributing the ignition timing signals to each cylinder and for turning the primary current of the ignition coil for each cylinder on and off on the basis of a dwell angle determined in accordance with engine speed; (3) a booster 12 serving as an ignition power supply; (4) plug units 13 including an ignition coil 5 and an ignition plug 9; (5) and low-voltage cables 14 for coupling ignition energy from the ignition unit 2 to the primary side of the ignition coil 5 for each cylinder. The system also includes ignition switch 15, and protection diode 16 for preventing the system from being damaged in case the plus and minus terminals are connected reversely to a battery 4.

Each ignition coil 5 and the corresponding ignition plug must be directly electrically connected in order to avoid use of high-voltage cables; however, the structure is not important. In other words, it is not important whether the ignition coil and the plug are constructed integrally or separably.

The actual circuit configurations of the above-mentioned basic elements are described infra with reference to FIGS. 3 to 9.

The ignition advance-angle control unit 1 may be chosen from any of several types, including the prior-art advance-angle mechanism; however, FIG. 3 is a block diagram of an exemplary digital circuit configuration including a microcomputer and a crank angle sensor made up of a gear-shaped disk fixed to the engine crank shaft and an electromagnetic pickup. In the case of a four-cylinder engine, 720-degree signal a, 180-degree signal b and one-degree signal c are all derived by the crank angle sensor 26. The 720-degree signal a is a train of pulse signals generated whenever the crankshaft has rotated through two revolutions. If the order of ignition of the cylinders is #1-#3-#4-#2, the timing is such that the trailing edge of each pulse occurs after ignition of the #2 cylinder but before ignition of the #1 cylinder. The 180-degree signal b is a train of pulse signals generated whenever the crankshaft has rotated through 180 degrees, the timing being such that the trailing edge of the pulse signal occurs at a position 70 degrees ahead of the compression top dead center in each cylinder. The one-degree signal c is a train of pulse signals generated whenever the crankshaft has rotated through one degree.

A counter 27 in the ignition advance-angle control unit 1 is reset by the 180-degree signal b, and the pulses of the one-degree signal c are counted from zero after derivation of each pulse of the 180-degree signal b in order to obtain binary-coded angle position information. The central processing unit 28 receives (1) an engine load signal Q detected by an intake air flow sensor 70, (2) a binary coded engine speed signal N detected by a speed sensor 71, and (3) an ignition reference advance-angle value A corresponding to signals Q and N; value A is derived from a ROM 29 via the table look-up method. Unit 28 converts the data supplied to it into an advance angle control signal Nc to register 30; signal Nc corresponds to the value (70°−A). The counted value d in the counter 27 is compared with the value in the register 30 by a comparator 31, which derives an ignition signal e when the counted value d in the counter 27 agrees with the advance-angle control signal Nc stored in the register 30. In the case of a four-cylinder engine, this ignition signal e is a pulse train generated whenever the crankshaft rotates through approximately 180 degrees, the precise timing of which is controlled in accordance with engine operating conditions.

The ignition unit 2 comprises a distributing unit 32 for distributing the above-mentioned ignition signal e to each cylinder on the basis of the 720-degree signal a derived from the crank angle sensor 26. A switching control unit 33 for each cylinder converts the output signals f, g, h and i from the distributing unit 32 into the switching control signals j, k, l, and m having dwell angles according to engine speed. Switching unit 34 turns the primary current of each ignition coil 5 on and off in response to the above-mentioned switching control signal. Current control unit 35 regulates the value of the primary current.

Figure 4:
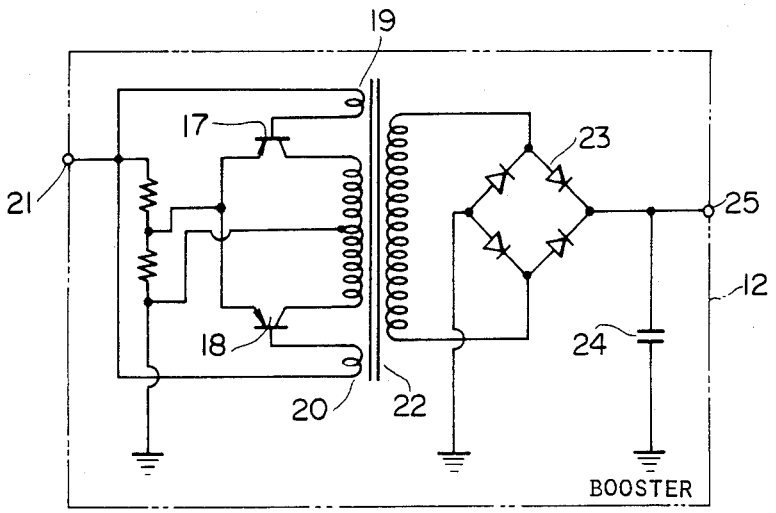
FIG. 4 is a circuit diagram of a booster used with the first embodiment of the ignition system according to the present invention.

FIG. 4 is a circuit diagram of DC-DC converter that can be used in the booster 12. In this DC-DC converter, two transistors 17 and 18 and the two primary coils (exciting coils) 19 and 20 of a transformer 22 form an oscillation circuit. Transistors are reciprocally turned on or off, that is oscillated, to boost the battery voltage applied to the input terminal 21 through the transformer 22. The boosted secondary voltage signal is smoothed by rectifier bridge 23 and a condenser 24 and supplied to output terminal 25. The conversion efficiency of this type of DC-DC converter is typically from 80 to 90 percent, so it is possible to efficiently boost the battery voltage.

In the case when the ignition coil 5 and the ignition plug 9 are assembled integrally, a small ignition coil is required; accordingly, it is necessary to reduce relatively low winding ratio. The low winding ratio results in a relatively low inductance and resistance on the secondary side of the ignition coil 5, whereby there are relatively low inductance and resistance on the primary side, with the result that there is a relatively low joule effect power consumption and relatively high energy conversion efficiency.

Booster 12 compensates for the reduced winding ratio of the ignition coil 5. If the winding ratio of the ignition coil 5 is half of the normal ratio the voltage applied to the primary side of the ignition coil 5 must be boosted from the usual automotive vehicle battery voltage of 12 V to 24 V; that is, the winding ratio of the transformer 22 of the booster 12 must be 1:2.

FIG. 4 is a circuit diagram of an exemplary circuit configuration of the distributing unit 32 that includes input terminals 36, 37 and 38 respectively responsive to ignition signal e, the 720 degree signal a, and the supply voltage (+V) from the power supply. Unit 32 responds to the signals on terminals 36–38 to supply signals f, g, h, i and e′ to output terminals 39–42 and 187. Modified ignition signal e′ is superfluous in the embodiment of FIG. 3, but it is advantageously used in other embodiments as described in detail later. Four bit shift register 43 (in the case of a four-cylinder engine) has a clock terminal CLK responsive to a logic "1" signal derived by cascaded inverters 44 and 45 whenever the ignition signal e is "1". On the other hand, if the 720-degree signal a is "1", inverter 46 causes one input terminal of the NOR gate 47 to be "0". At this time, since the output of a monostable multivibrator 48 applied to the other input terminal of the NOR gate 47 is also "0", a "1" is supplied by NOR gate 47 to the reset terminal R of the shift register 43 to reset it.

If the order of cylinder ignition is #1-#3-#4-#2, the shift register 43 always starts counting from the ignition signal corresponding to the #1 cylinder and squentially supplies signals f, g, h, and i to the corresponding output terminals 39 to 42, each associated with one cylinder. The shift register 43 is reset when the 720-degree signal a is "1" after the last stage signal e has been derived. The same counting operations are repeatedly performed thereafter. The monostable multivibrator 48 is triggered by the first stage output signal f of the shift register 43 and keeps supplying a "1" signal to the NOR gate 47, until immediately before the next 720-degree signal a is supplied to gate 47; thereby the rest input (B) of the shift register 43 is latched shift at "0". Shift register 43 is thus protected from erroneous signals due to noise, that is, from misorder of cylinder ignition.

Figure 6:
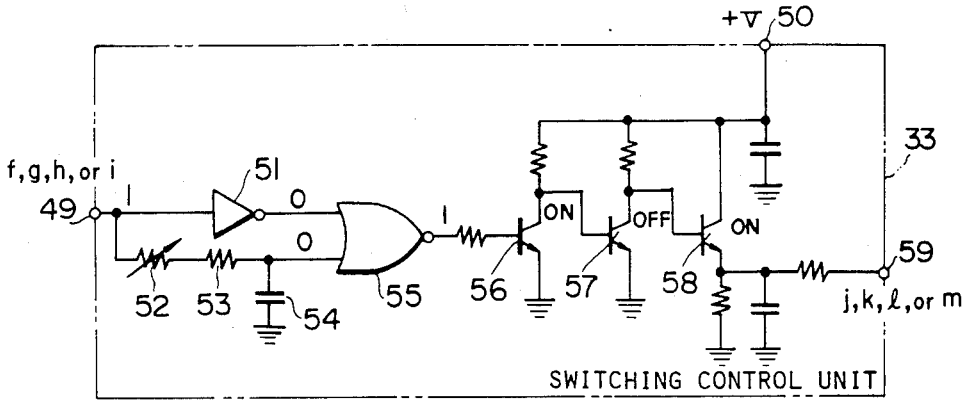
FIG. 6 is a circuit diagram of a switching control unit used with the first embodiment of the ignition system according to the present invention.

FIG. 6 shows is a circuit diagram of an exemplary circuit configuration of the switching control unit 33. One of the signals f, g, h, and i from the distributing unit 32 is applied to the input terminal 49 of the switching control unit 32 provided for the corresponding cylinder and the power supply voltage (+V) is applied to the input terminal 50. When the input signal at terminal 49 is "1", one input of the NOR gate 55 is held at "0" via the inverter 51, and the other input of the NOR gate 55 is held at "0" until the output of an integration circuit made up of resistors 52 and 53 and a condenser 54 reaches a predetermined threshold value. Therefore, the output of the NOR gate 55 is "1", causing cascaded transistors 56, 57 and 58 to be respectively activated to the conducting (on), non-conducting (off) and on states so a switching control signal is coupled to the output terminal 59. The pulse width of the switching control signal corresponds to ignition duration and is determined by the time constant of the above-mentioned integration circuit. As engine speed increases, dwell angle increases, since the ignition pulse duration remains constant while the ignition frequency increases. In summary, the ignition signal e derived from the ignition advance-angle control unit 1 is processed to include a dwell angle factor and is supplied to the appropriate cylinder.

Figure 7:
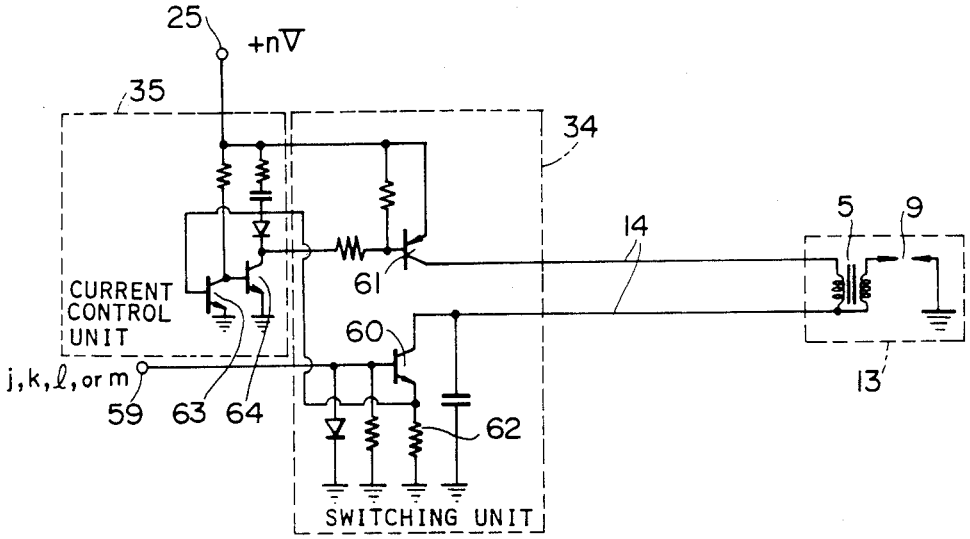
FIG. 7 is a circuit diagram of a switching unit and a current control unit used with the first embodiment of the ignition system according to the present invention.

FIG. 7 is a circuit diagram of the switching unit 34 and the current control unit 35. An appropriate one of the switching control signals j, k, l, and m obtained from the switching control unit 33 is applied to one of the switching unit 34 in order to turn the primary current of the ignition coil 5 on and off. The appropriate signal j, k, l or m drives switching power transistor 60, connected to the primary side of the ignition coil. While the power transistor 60 is on, the current supplied from the booster 12 of FIG. 4 passes to the primary side of the ignition coil 5 via a current controlling transistor 61. When the primary current is cut off by turning the power transistor 60 off, the high-voltage generated on the secondary side of the ignition coil is applied between the electrodes of the ignition plug 9 to generate a spark.

When the terminal voltage across a primary current detection resistor 62, connected to the emitter side of the power transistor 60, exceeds a predetermined value due to an increase in the primary current of the ignition coil, the transistor 63 in the current control unit 35 goes on and the transistor 64 goes off, so that the internal resistance between emitter and collector of the current controlling transistor 61 increases, whereby the primry current decreases. When the primary current decreases to a predetermined value, the transistors 63 and 64 are switched back to the original stage. Therefore, since the internal resistance of the current controlling transistor 61 decreases, the primary current is roughly restricted to a constant value while repeatedly hunting near the predetermined value.

On the other hand, if the output voltage of the booster 12 is likely to exceed the maximum voltage rating of the transistors 60 and 61, it is possible to configure the switching unit by using a thyristor in place of the power transistor 60.

Figure 8:
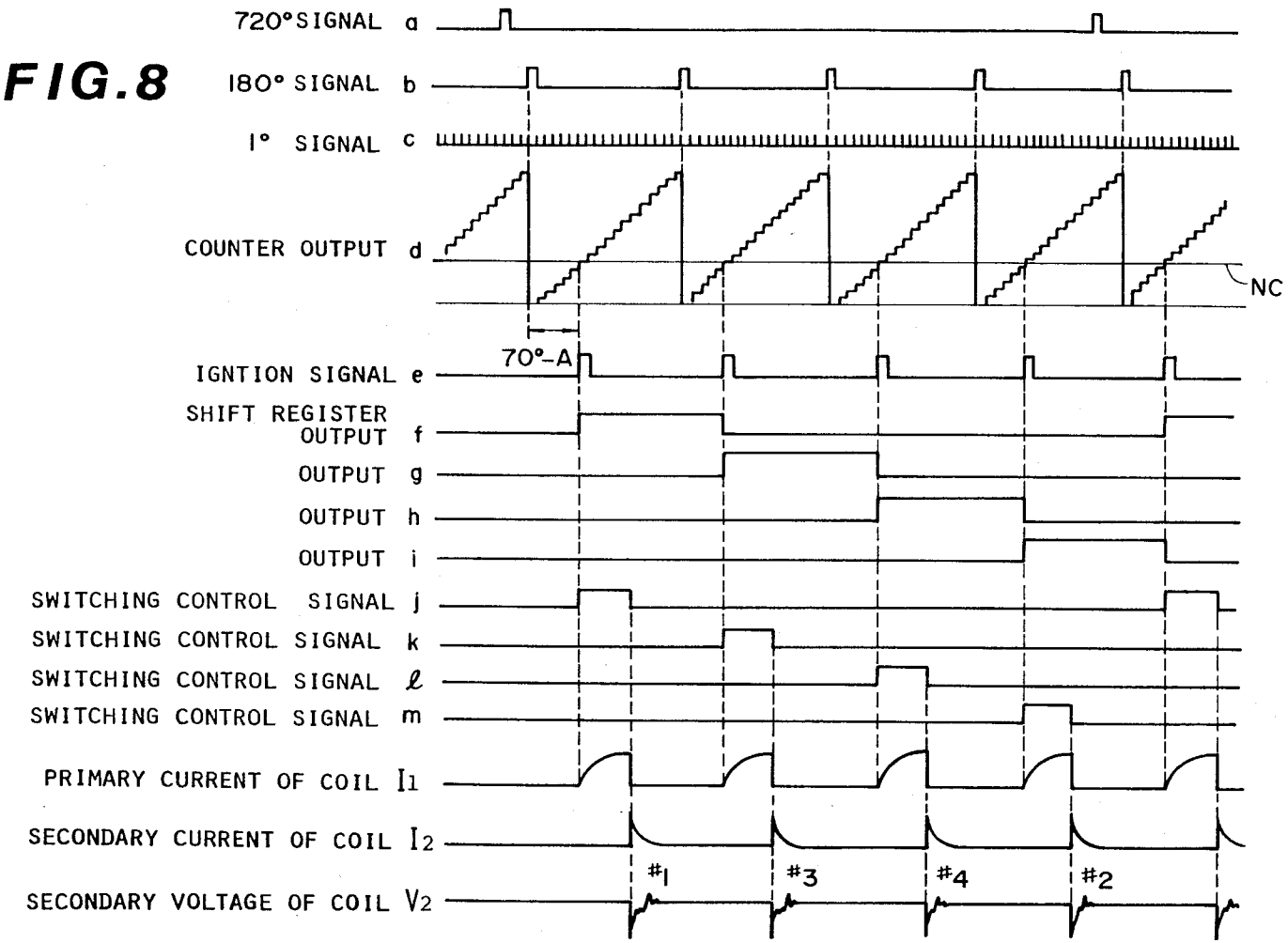
FIG. 8 is a timing chart for the first embodiment of the ignition system for an internal combustion engine according to the present invention.

FIG. 8 is a timing chart indicating the timing relationships among the above-mentioned signals a to m, the primary current $I_1$, of the ignition coil, the secondary current $I_2$ thereof, and the secondary voltage $V_2$.

Figure 9:
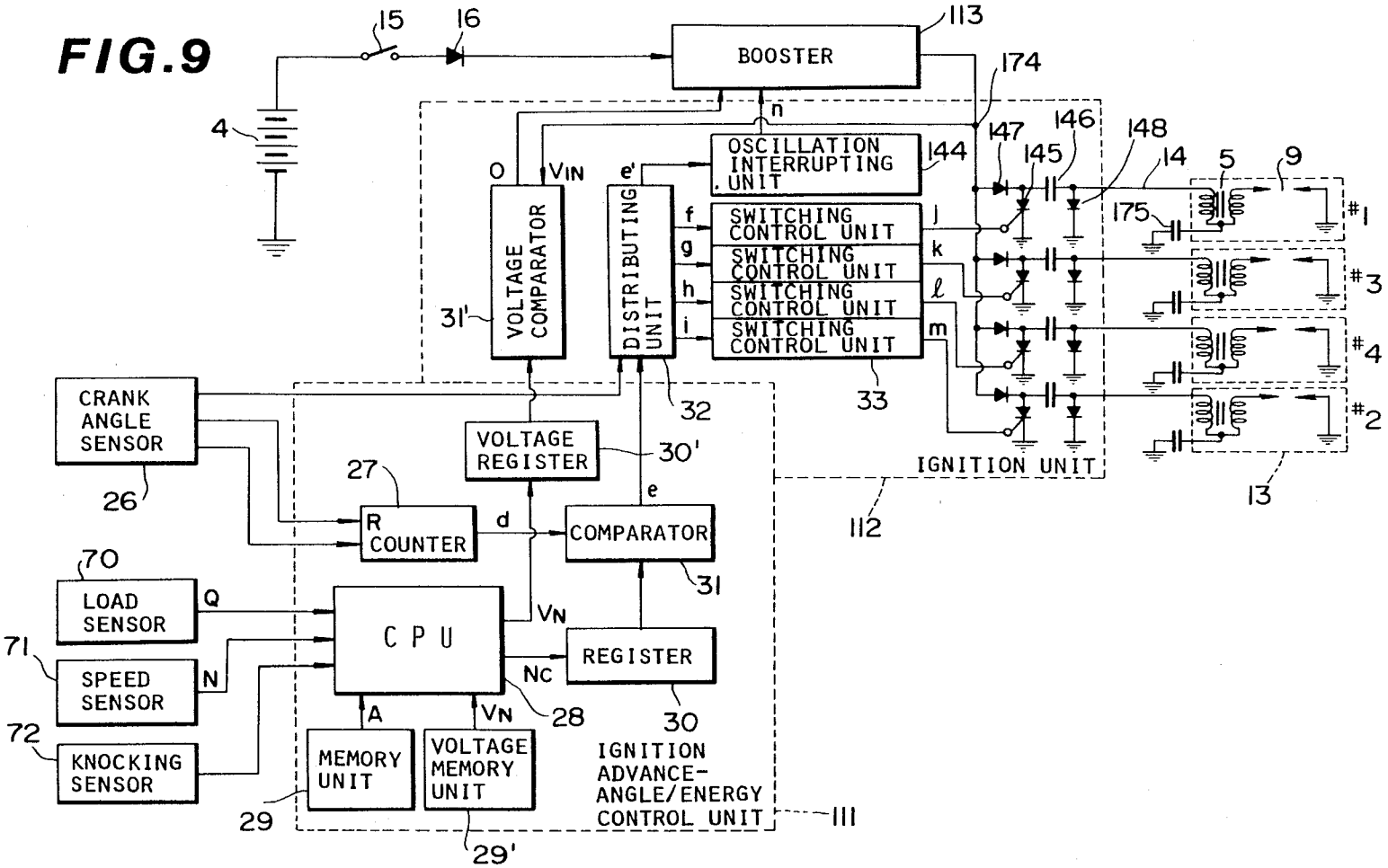
FIG. 9 is a schematic block diagram of a second embodiment of the ignition system for an internal combustion engine according to the present invention.

FIG. 9 is a schematic block diagram of a second embodiment of the ignition system for a four-cylinder internal combustion engine according to the present invention. The ignition system mainly comprises an ignition advance-angle/energy controlling unit 111, an ignition unit 112, a voltage booster 113, plug units 13 including an ignition coil 5 and an ignition plug 9, and low-voltage cables 14 for connecting the ignition unit 112 to the primary side of each ignition coil 5.

The actual circuit configurations of the above-mentioned basic elements are described with reference to FIGS. 9 to 12.

The ignition advance-angle/energy control circuit 111 can be embodied with a microcomputer.

In FIG. 9 crank angle sensor 26 includes a gear-shaped disk fixed to the crank shaft and an electromagnetic pickup. In the case of a four-cylinder engine, a 720-degree signal a, a 180-degree signal b and a one-degree signal c are derived from the crank angle sensor 31. The 720-degree signal a is a train of pulse signals generated whenever the crankshaft has rotated through two revolutions. If the ignition order of each cylinder is #1-#3-#4-#2, the timing is predetermined such that the trailing edge of each pulse signal occurs after the ignition of the #2 cylinder and before the ignition of the #1 cylinder. The 180-degree signal b is a train of pulse signals generated whenever the crankshaft has rotated through 180 degrees. The timing is such that the trailing edge of each pulse signal occurs at a position 70 degrees ahead of the compression top dead center in each cylinder. The one-degree signal c is a train of pulse signals generated whenever the crankshaft has rotated through one degree.

A counter 27 is reset by the 180-degree signal b, and counting of the one-degree signal c is started in response to each pulse of the 180-degree signal b in order to obtain binary-coded angle position information. The central processing unit 28 receives (1) an engine load signal Q from an intake air flow sensor 70 (air-flow meter) and, (2) an engine speed signal N from an engine speed sensor 71, and (3) a reference ignition advance angle value A corresponding to values Q and N; value A is derived from a ROM 29 via the table look-up method. Unit 28 converts the signal A into an advance angle control signal Nc corresponding to the value $(70°-A)$. When knocking occurs under low-speed, heavy-load condition, the advance-angle control signal Nc is corrected on the basis of the signal from a knocking sensor 72. That is to say, the value of signal Nc is modified to be $70°-(A-\alpha)$, where $\alpha$ falls within a predetermined range according to the degree of sensed knocking (intensity, rate of occurrence) and the calculated advance-angle control signal Nc is transferred to a register 30. The comparator 31 compares the counted value Nc of the counter 27 with the advance-angle control signal value Nc transferred to the register 30 and derived an ignition signal e when both the signals match. Comparator supplies signal e to the distributing unit 32 in the ignition unit 112.

The ignition unit 112 generally includes a distributing unit 32, switching control units 33, an oscillation-interrupting circuit 144, thyristors 145, ignition energy condensers 146, and diodes 147 and 148 used in the charging circuits of the condensers.

Figure 5:
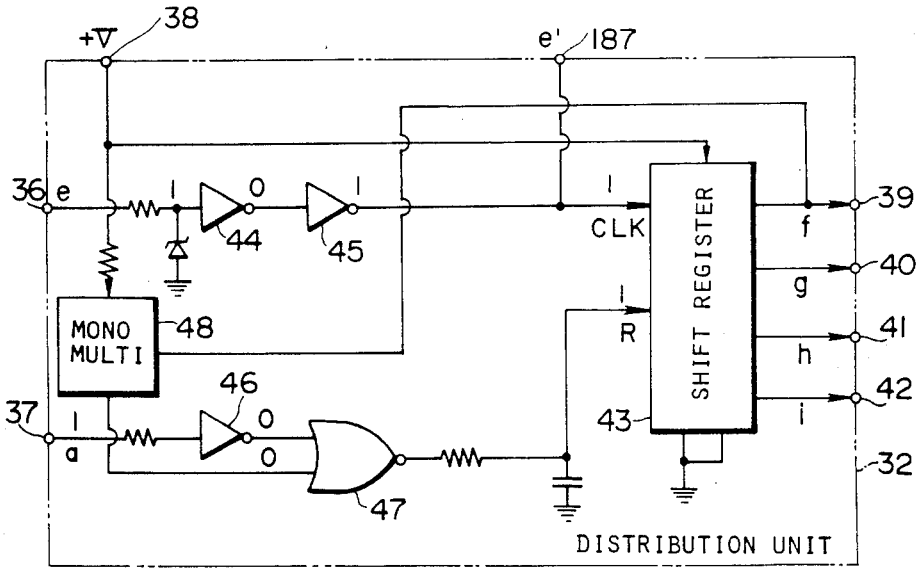
FIG. 5 is a circuit diagram of a distribution unit used with the first embodiment of the ignition system according to the present invention.

The distribution unit 32 is configured as already known in FIG. 5. The only difference in this embodiment is that the modified signal e' from the output terminal 187 is transmitted to the oscillation-interrupting circuit 144 as an oscillation-interrupt command signal. The circuit of FIG. 5 includes input terminals 36, 37 and 38 respectively responsive to ignition signal e, the 720 degree signal a, and an input terminal for the supply voltage (+V) from the power supply; signals f, g, h, and i are respectively derived on output terminals 39, 40, 41 and 42. Four-bit shift register 43 (in the case of a four-cylinder engine) has a clock terminal CLK responsive to a logic "1" derived by cascaded inverters 44 and 45 whenever the ignition signal e is "1". On the other hand, if the 720-degree signal a is "1", inverter 46 causes one input terminal of the NOR gate 47 to be "0". At this time, since the output of a monostable multivibrator 48 applied to the other input terminal of the NOR gate 47 is also "0", a "1" is supplied by NOR gate 47 to the reset terminal R of the shift register 43 to reset it.

If the order of cylinder ignition is #1-#3-#4-#2, the shift register 43 always starts counting from the ignition signal corresponding to the #1 cylinder and sequentially supplies signals f, g, h, and i to the corresponding output terminals 39 to 42, each associated with one cylinder. The shift register 43 is reset when the 720-degree signal a is "1" after the last stage signal e has been derived. The same counting operations are repeatedly performed thereafter. The monostable multivibrator 48 is triggered by the first stage output signal f of the shift register 43 and keeps supplying a "1" signal to the NOR gate 47, until immediately before the next 720-degree signal a is supplied to gate 47; thereby the reset input (R) of the shift register 43 is latched at "0". Shift register 43 is thus protected from erroneous signals due to noise, that is, from misorder of cylinder ignition.

The switching control unit 33 is configured as shown in FIG. 6. One of the signals f, g, h, and i from the distributing unit 32 is applied to the input terminal 49 of the switching control unit 32 provided for the corresponding cylinder and the power supply voltage (+V) is applied to the input terminal 50. When the input signal at terminal 49 is "1", one input of the NOR gate 55 is held at "0" via the inverter 51, and the other input of the NOR gate 55 is held at "0" until the output of an integration circuit made up of resistors 52 and 53 and a condenser 54 reaches a predetermined threshold value. Therefore, the output of the NOR gate 55 is "1", causing cascaded transistors 56, 57 and 58 to be respectively activated to the conducting (on), non-conducting (off) and on states so a switching control signal is coupled to the output terminal 59.

The switching control signals j, k, l, m thus produced are applied to the gate terminals of the thyristors 145 in FIG. 9, causing the thyristors to be turned on in the order of ignition. The pulse width of the switching control signals can be adjusted by a resistor 52 shown in FIG. 6 so as to turn on the thyristors 145 sufficiently.

In FIG. 9, the condensers 146, one of which is provided for each cylinder are charged through diodes 147 and 148 to a voltage of 300 to 400 V by the DC output terminal 174 of the booster 113 while the thyristors 145 are turned off. The minus terminals of these condensers are connected to one terminal of the primary winding of each ignition coil 5 via low-voltage cables 14. When the thyristors 145 are turned on, a part of electric charge stored in the condensers 146 is discharged through the primary winding of the ignition coil 5 connected to particular condenser. At the moment of discharge, a high-voltage is generated on the secondary side and applied to the ignition plugs 9 directly connected to the ignition coils 5 in order to generate a spark. Condensers 175 connected between the primary side of the ignition coil 5 and ground serve to limit the primary current. These condensers 175 have smaller capacity than those of the condensers 146 (about one-fourth), so that after the condenser 175 is fully charged, no primary current flows through the ignition coil 5, and the remaining electric charge of the condenser 146 directly supplies ignition energy to the spark gap of the ignition plug 9 which begins to discharge the secondary voltage for a period of time determined by to the pulse widths of signals j, k, l, and m. As described above, each cylinder is ignited in the predetermined order by the discharge of the corresponding condenser 146.

Figure 10:
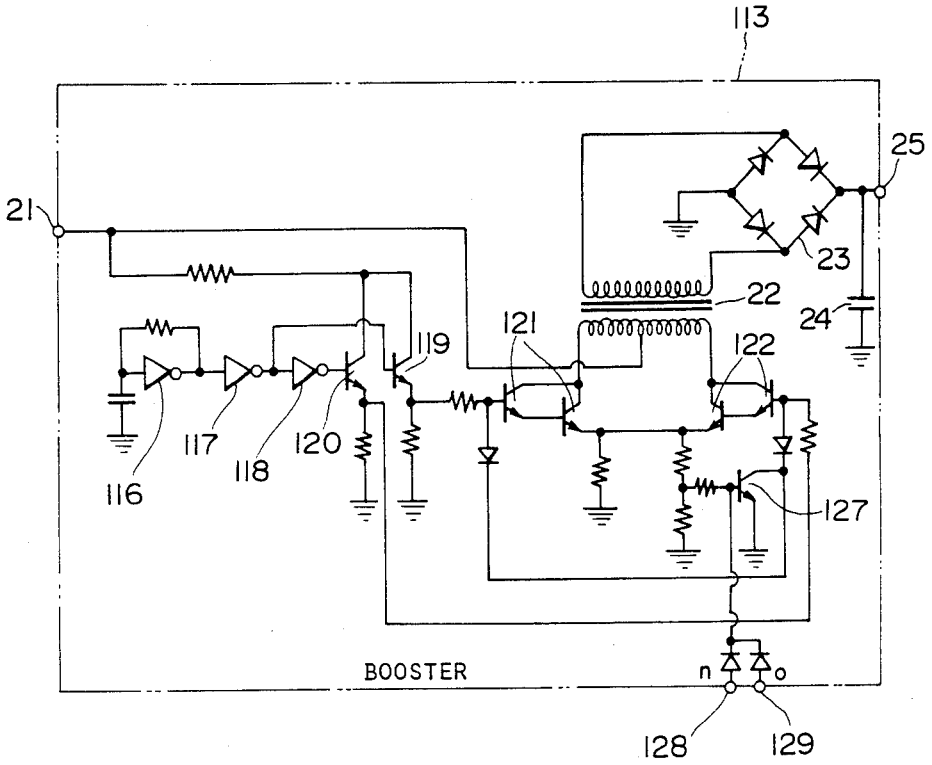
FIG. 10 is a circuit diagram of another booster used with the second embodiment of the ignition system according to the present invention.

FIG. 10 is a circuit diagram of a DC-DC converter that can be used as booster 113. This DC-DC converter alternately applies the oscillation output signal of a monostable multivibrator 116 to two pairs of Darlington transistors 121 and 122 via inverters 117 and 118 and transistors 119 and 120 to drive the primary side oscillator of a transformer 22. Therefore, a battery voltage (12 V) applied to the input terminal 21 is boosted to an AC voltage of 300 to 400 V; the secondary voltage is rectified into a DC voltage via a rectifier bridge 23; the DC output voltage of bridge 23 is derived at the output terminal 25 and supplied to terminal 174 (FIG. 9). In the circuit of FIG. 10, a control transistor 127 is connected between the input terminals of two pairs of Darlington transistors 121 and 122 and ground in order to selectively cut off power to the transformer 22. This control transistor 127 is turned on when a control signal is supplied to either of the input terminals 128 and 129, to stop the oscillation of the converter temporarily, as explained later. The power supply terminal 21 is also connected to the transistors 121 and 122. The conversion coefficient of this type DC-DC converter is from 80 to 90 percent so that it is possible to effectively boost the battery voltage.

Figure 11:
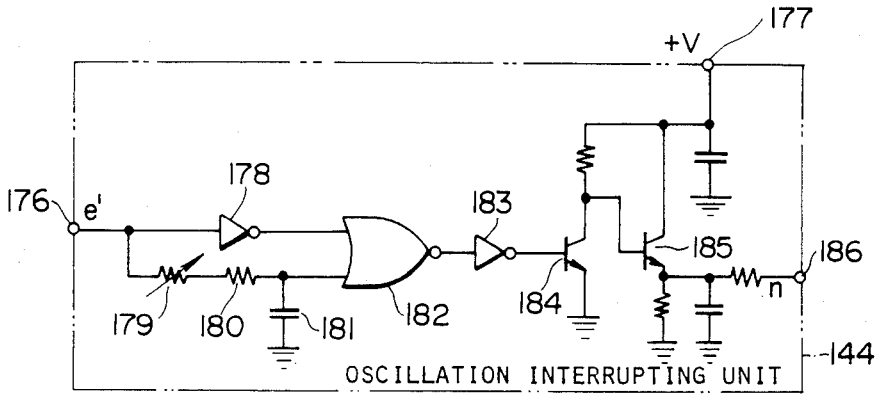
FIG. 11 is a circuit diagram of an oscillation halting unit used with the second embodiment of the ignition system according to the present invention.

FIG. 11 is a circuit diagram of an oscillation-interrupting unit 144. for preventing current from flowing from the booster 113 while the condenser 146 is discharging. The circuit 144 includes an inverter 178, resistors 179 and 180, a condenser 181, a NOR gate 182, an inverter 183, and transistors 184 and 185. Circuit 144 is activated by a power supply voltage (+V) connected to the input terminal 177. The operation of circuit 144 is largely the same as that of the switching control unit 33 shown in FIG. 6. When the interrupt command signal e' (having the same waveform as that of the ignition signal e) from the terminal 187 of the distribution unit 32 is applied to the input terminal 176 thereof, a signal n having a constant pulse width, determined by the values of the resistors 179 and 180 and the condenser 181, is produced at the output terminal 186. In response to the pulse signal n applied to the input terminal 128 of the booster 113, FIG. 10, having a high level, the booster oscillator stops oscillating temporarily. This occurs since the control transistor 127 is conducting to latch the inputs of the transistors 121 and 122 at a zero-voltage level. It is thus possible to prevent current from flowing from the booster 12 when one of the thyristors 145 is turned on by the signal from the switching control unit 33. When the condenser 146 ceases discharging, the thyristor 145 is turned off. Thereafter, the booster 12 begins oscillating again to recharge discharged condenser 146.

The ignition energy is controlled as follows: As understood from the description above, the ignition energy is determined by the electrostatic energy ($\frac{1}{2}$ $CV^2$, where C is the capacitance and V is the voltage of condenser 146) stored in the condenser 146. Therefore, by controlling the charging voltage of the condenser 146, it is possible to control the ignition energy supplied to each cylinder to an appropriate value corresponding to engine operating conditions. Therefore, in the ignition system shown in FIG. 9, data representing ignition energy (condenser-charging voltage) according to engine operating conditions are stored into ROM a voltage memory unit 29; which is part of the ignition advance-angle/ignition energy control circuit 111; the preset value $V_N$ of the condenser charging voltage representing input information such as engine load signal, engine speed signal, coolant temperature signal, starter signal, throttle opening rate signal is read out by the central processing unit 28 via the table look-up method and is transferred to the voltage register 30'.

In order to implement the present invention, the voltage value $V_n$, derived when the engine is being started, is idling, and is operating with a lean mixture under steady engine operation is set higher than it is for other cases in order to increase ignition energy.

Figure 12:
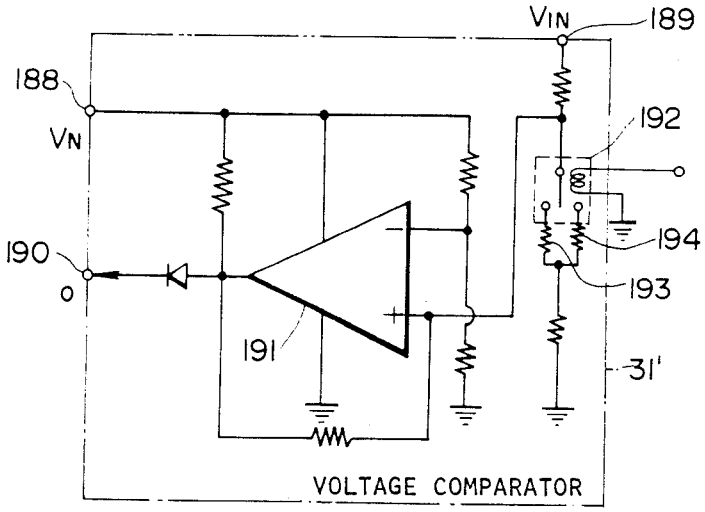
FIG. 12 is a circuit diagram of a voltage comparator used with the second embodiment according to the present invention.

FIG. 12 is a cicuit diagram of a circuit configuration of the voltage comparator 31' in the ignition unit 112. The voltage comparator 31' monitors the charging voltage $V_{IN}$ at output terminal 174 of the booster 113, and applies a control signal 0 to the booster 113 when the charging voltage $V_{IN}$ agrees with the present voltage $V_N$ in the register 30' to stop the oscillation of the booster 113, thereby feedback controlling the charging voltage of the condenser 146. An analog voltage representing the preset voltage value $V_N$, as derived by register 30' and converted by a converter (not shown), is supplied to input terminal 188. Input terminal 189 responds to the charging voltage $V_{IN}$. Comparator 31' includes output terminal 190 on which a "1" output signal is derived when the preset voltage value $V_n$ and the charging voltage $V_{IN}$ are indicated as matching by operational amplifier 191. When the signal at terminal 190 is applied to the input terminal 129 of the booster 113 shown in FIG. 10 as a control signal 0, the controlling transistor 127 is turned on to stop oscillation in the booster 113. Thus, the charging voltage of the condenser 146 shown in FIG. 9 is limited to the preset voltage value. Further, the circuit of FIG. 12 includes switching relay 192 selects one of the resistors 193 and 194 in order to change the charging voltage $V_{IN}$ applied to the input terminal 189. Relay 192 is used to adjust the preset voltage value $V_N$ according to engine operating conditions.

Figure 13:
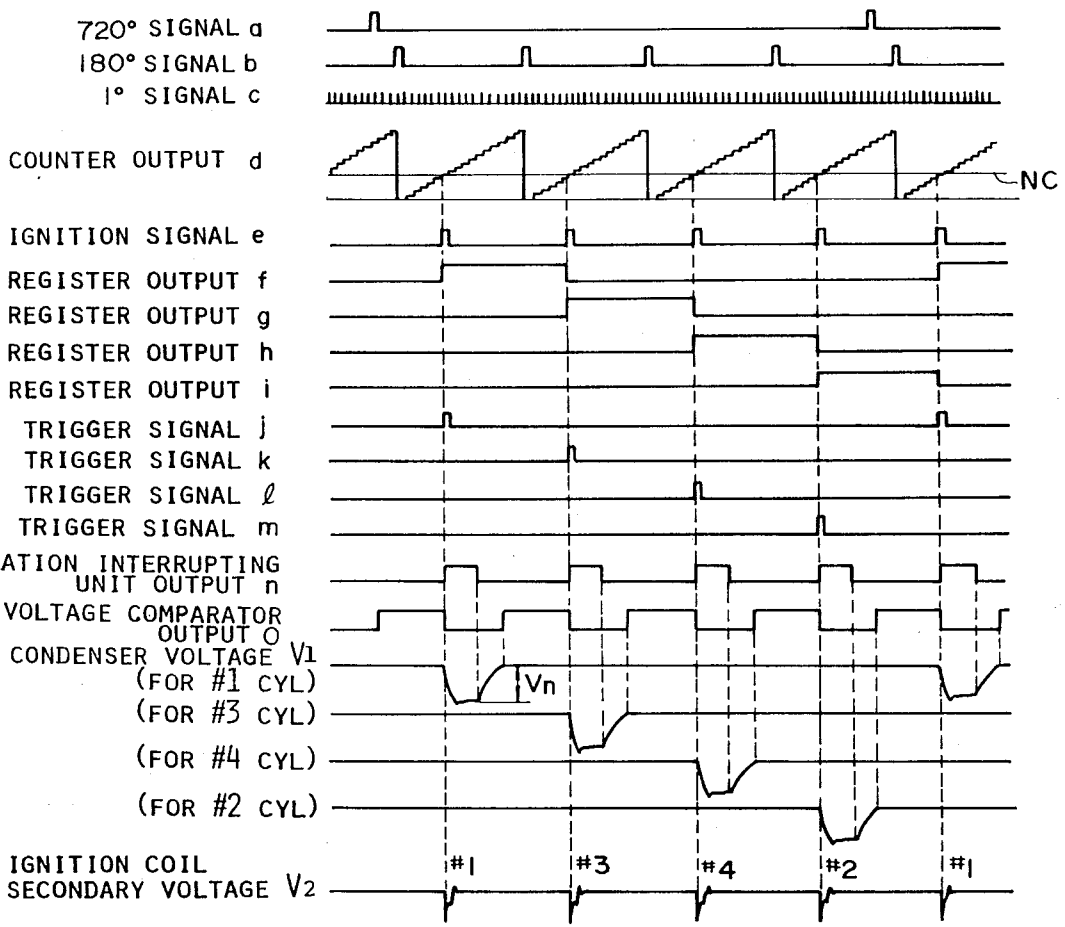
FIG. 13 is a timing chart of the second embodiment of the ignition system for an internal combustion engine according to the present invention.

FIG. 13 is a timing chart indicating the timing relationships among the above-mentioned signals a to 0, the condenser voltage $V_1$, and the secondary voltage $V_2$ of the ignition coil.

Figure 14:
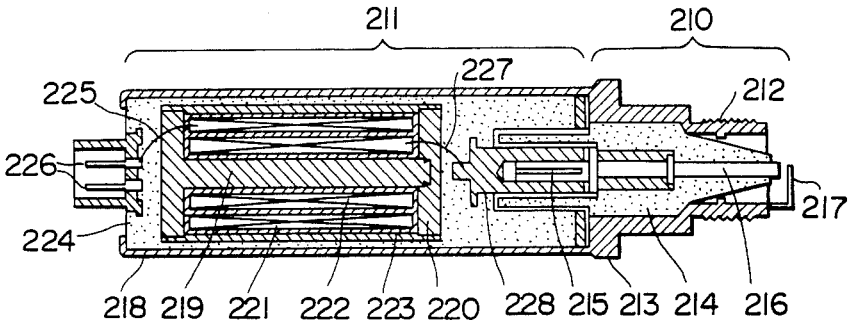
FIG. 14 is a cross-sectional view of a first embodiment of the integral coil-type ignition plug unit according to the present invention.

FIG. 14 is a cross-sectional view of a first embodiment of an integral-coil type ignition plug unit according to the present invention. The plug of FIG. 14 includes ignition plug portion 210, and ignition coil portion. The ignition plug portion 211 210 comprises a housing 213 provided with a mounting screw portion 212, a fireproof insulator 214, a central electrode 216 with a pin 215 at one end retained at the center of the insulator, and a grounded electrode 217 attached to the housing 213. A spark gap is provided between the exposed end of the central electrode 216 and the grounded electrode 217. Plug portion 210 is similar to conventional spark plugs.

Figure 16:
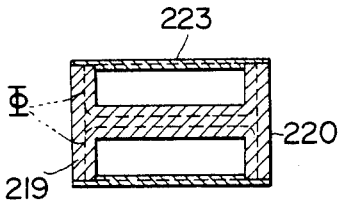
FIG. 16 is a cross-sectional view of an iron core portion of the ignition coil.

In the ignition coil portion 211, within a cylindrical case 218 formed integrally with the housing 213 of the ignition plug, a primary coil 221 and a secondary coil 222 are wound around an I-shaped iron core made up of a T-shaped iron bar 219 and straight iron bar 220 in combination. Outside of the core, a closed magnetic path-type coil is wound within a cylindrical yoke 223 in such a way that grooves 223*a* on the inside surface of the yoke 223 engage the rounded edges 219*a* and 220*a* of the cross-bars of the iron core elements 219 and 220. An insulating material 224, such as synthetic resin, acts as a buffer between the case 218 and the cylindrical yoke 223. Therefore, since the entire magnetic flux $\phi$ generated by the ignition coil passes through a magnetic path made up of the T-shaped iron bar 219, the straight iron bar 220 and the cylindrical yoke 223, as shown in FIG. 16, it is possible to obtain an ignition coil with a high energy conversion efficiency and limited magnetic dispersion losses.

The primary winding lead wire 225 of the ignition coil is connected to a low-voltage terminal 226 provided at one end of the case 218. A high-voltage terminal 228 connected to the secondary winding lead wire 227 is directly connected to a terminal pin 215 connected to the central electrode 216 via pin 215 of the ignition plug. Therefore, the high-voltage generated across the secondary coil 222 is directly applied to the spark gap of the ignition plug 210 without the need for high-voltage cables, so that ignition energy can be efficiently utilized.

Figure 15:
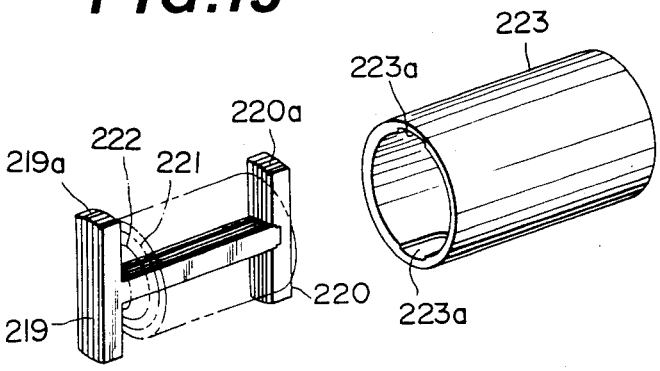
FIG. 15 is an exploded, perspective view of the ignition coil shown in FIG. 14.
Figure 17:
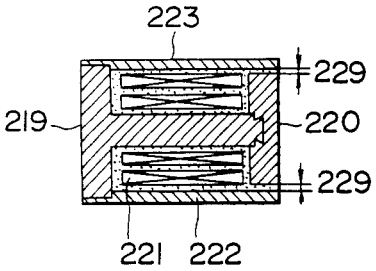
FIG. 17 is a cross-sectional view of a second embodiment of the integral coil-type ignition plug unit according to the present invention.

FIG. 17 is a cross-sectional view of another embodiment of the closed magnetic path type ignition coil incorporated in the ignition plug unit according to the present invention. Although the closed magnetic path is made up of a T-shaped iron bar 219, a straight irong bar 220 and a cylindrical iron yoke 223 similar to the embodiment shown in FIGS. 14 to 16, a gap 229 is provided between the straight iron bar 220 and the cylindrical yoke 223 so as to limit the amount of magnetic flux to a range near the maximum effective magnetic flux. This gap 229 prevents magnetic saturation of the iron core, and serves to reduce the size of the ignition coil by allowing the cross-sectional area of the core to be decreased.

Figure 18:
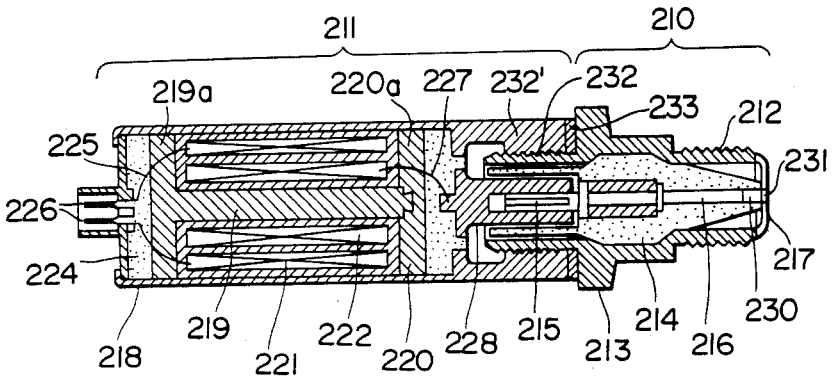
FIG. 18 is a cross-sectional view of a plasma plug according to a further embodiment of the invention.

FIG. 18 is a cross-sectional view of another embodiment according to the present invention which is applied to a plasma ignition plug. The plasma ignition plug includes a small chamber 230 defined by a ceramic insulator 214 between the central electrode 216 and the grounded electrode 217 of the ignition plug 210. A spark is generated as a result of a discharge along the internal surface of the small chamber 230 due to high-voltage applied across the electrodes. The high-temperature plasma generated by this spark jets out of an aperture 231 formed in the grounded electrode 217 into the air-fuel mixture to perform high-energy ignition.

In this embodiment, the ignition plug portion 210 and the ignition coil portion 211 are removably engaged by a screw joint so that the ignition plug portion 210 can be easily replaced if necessary. Plug housing 213 includes male threaded portion 232 and ignition coil case 218 including female threaded portion 232'; gasket 233 is between portions 232 and 232'. The iron core of the ignition coil is made up of a T-shaped iron bar 219 and a straight iron bar 220. By engaging the end surfaces of the iron cores 219*a* and 220*a* with the inner surface of the magnetic case 218, the size of the ignition coil is reduced by substituting part of the case 218 for the cylindrical yoke 223 shown in FIGS. 14 to 17. The structure is the same as in FIG. 15, except as noted above.

Figure 19A:
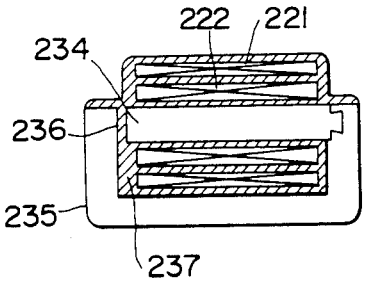
FIGS. 19(*a*) and 19(*b*) are cross-sectional views of another embodiment of a closed magnetic path ignition coil included in an ignition plug.
Figure 19B:
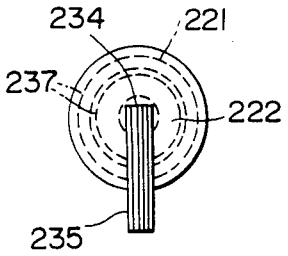

FIG. 19 is a cross-section of yet another embodiment of the closed magnetic path type ignition coil incorporated in the ignition plug, in which the closed magnetic path includes a saturation-prevention gap 236 by forming the iron core from a straight iron bar 234 and a channel-shaped iron yoke 235. An insulating material 237 separates the primary and secondary coils 221 and 222 from each other and from the iron core, and also fills the saturation-prevention gap 236 betwen the free ends of the bar 234 and the yoke 235.

The iron core and the yoke of the ignition coils shown in FIGS. 14 to 19 is preferably formed of silicon steel or a laminated ferrite may be used to reduce joule effect due to eddy current.

As described above, according to the present invention, it is possible to eliminate some parts, which otherwise would induce large power losses, such as a center cable, high-voltage cables, a mechanical distributor, etc. used in conventional ignition systems, and to eliminate wasteful consumption of ignition energy inevitably induced in the conventional two-cylinder simultaneous-ignition method. Furthermore, since the condensers are charged by boosting the battery voltage and the stored ignition energy is discharged through the primary side of the ignition coil to obtain a spark voltage, the winding ratio of the ignition coil can be reduced to decrease joule effect. As a result, it is possible to reduce power consumption noticeably (perhaps by about a factor of two) as compared with a conventional ignition system, thus improving actual travelling fuel consumption rate.

Further, by controlling the ignition energy according to engine operating conditions and be performing more intense ignition when the engine is being started, is idling or is operating under steady light-load conditions, it is possible to operate the engine stably with a small amount of power in order to further improve the fuel consumption rate.

Additionally, since the ignition coil is integrally formed with the ignition plug, since the number of parts of the ignition system is reduced, especially due to elimination of the mechanical distributor, and since high-voltage cables subjected to leakage due to moisture or to malignition due to deterioration in insulation characteristics are eliminated, it is possible to improve mass productivity, and to realize a nearly maintenance-free ignition system.

It will be understood by those skilled in the art that the foregoing description is in terms of preferred embodiments of the present invention wherein various changes and modifications may be made without departing from the spirit and scope of the invention, as is set forth in the appended claims.

What is claimed is:

1. An ignition system for a multi-cylinder internal combustion engine, which comprises:

(a) a crank angle sensor for detecting crank angles and generating a plurality of crank angle signals a, b and c corresponding thereto;

(b) a load sensor detecting intake air flow rate of the engine and generating engine load signals Q corresponding thereto;

(c) an engine speed sensor for detecting engine speed and generating engine speed signals N corresponding thereto;

(d) an ignition advance-angle control unit including:

(1) a memory unit for storing reference ignition advance-angle values A corresponding to engine load and engine speed;

(2) a central processing unit connected to said load sensor, said speed sensor, and said memory unit for reading the detected engine load signal Q and engine speed N, determining appropriate reference ignition advance-angle values A corresponding to the detected engine load and engine speed in table look-up method, and executing calculations to obtain advance-angle control signals Nc;

(3) a register connected to said central processing unit for temporarily storing the advance-angle control signals Nc;

(4) a counter connected to said crank angle sensor for counting the crank angle signal c to determine crank angle positions and deriving a counted value d corresponding thereto, said counter being reset by the crank angle signal b; and (5) a comparator connected to said counter and said register for comparing the counted value d from said counter with the advance-angle control signal Nc from said register and generating ignition signals e when the counted value d matches the advance-angle control signal Nc;

(e) a booster connected to a power supply for boosting a supply voltage of the power supply and deriving a boosted supply voltage corresponding thereto;

(f) an ignition unit including:

(1) a distributing unit connected to said crank angle sensor and said comparator for distributing the ignition signals e from said comparator on the basis of the crank angle signal a from said crank signal sensor and generating output signals f, g, h and i classified into the respective cylinders;

(2) a plurality of switching control units connected to said distributing unit for generating switching control signals j, k, l, and m in response to the output signals f, g, h and i from said distributing unit;

(3) a plurality of thyristors, each having gate and anode terminals respectively connected to said respective control units and said booster, said thyristors being sequentially fired in response to the switching control signals j, k, l, and m from said switching control unit in the ignition order of the cylinders;

(4) a plurality of ignition energy condensers each having a terminal connected to the anode terminal of a separate one of said thyristors for directly charging ignition energy from said booster and discharging the charged ignition energy through said respective thyristors in response to the switching control signals j, k, l, and m from said switching control unit; and (5) an oscillation interrupting unit connected to said booster and said distributing unit for interrupting the oscillation of said booster for a predetermined period of time during which said condensers are being discharged in order to prevent current from flowing from said booster to said condenser whenever the ignition signals e are derived by said distributing unit;

(g) a plurality of ignition coils, each having a first primary side terminal which is separately connected to a second of one of said ignition energy condensers and a second primary side terminal which is separately connected to the cathode of one of said thyristors for generating high-voltage on the respective secondary side thereof when ignition energy charged in said respective ignition energy condensers is discharged through said thyristors connected to it in response to the switching control signals j, k, l and m from said switching control unit; and (h) a plurality of ignition plugs, each of the plugs being separately connected to the secondary side of one of said ignition coils so a spark is generated between electrodes of each plug in response to the high-voltage generated by the ignition coil connected to the plug.

2. An ignition system for a multi-cylinder internal combustion engine as set forth in claim 1 which further comprises a knocking sensor connected to said central processing unit for detecting the presence of engine knocking and deriving the signals corresponding thereto, the detected engine knocking signal being used for correcting the determined reference ignition advance-angle values A corresponding to the degree of engine knocking.

3. An ignition system for a multi-cylinder internal combustion engine as set forth in claim 1, which further comprises:

(a) a voltage memory unit connected to said central processing unit for storing reference condenser charging-up voltage values Vn corresponding to engine load and engine speed, said central processing unit determining reference condenser charging-up voltage values Vn corresponding to the detected enging load and engine speed in table look-up method and deriving the signals corresponding thereto;

(b) a voltage register connected to said central processing unit for temporarily storing the determined condenser charging-up voltage values Vn; and (c) a voltage comparator connected to said register and said booster for comparing the voltage $V_{IN}$ derived by said booster with the determined condenser charging-up voltage Vn from said voltage register and supplying a control signal O to said booster in order to stop the oscillation of said booster when the voltage $V_{IN}$ matches the voltage Vn.

4. An ignition system for a multi-cylinder internal combustion engine as set forth in claim 3, wherein the reference condenser charging-up voltages $V_N$ are preset at relatively higher values to increase ignition energy when the engine operates at relatively low speed.

5. An ignition system for a multi-cylinder internal combustion engine as set forth in claim 1, which further comprises a plurality of small condensers connected between the respective cathode terminals of said thyristors and the respective primary side terminals of said ignition coils, for supplying the remaining electric charged energy for a predetermined period to the spark gaps of said ignition plugs where spark has already been generated by the high-voltage induced by the secondary voltage of said ignition coils after said small condensers are charged up, the capacity of said small condensers being smaller than that of said ignition energy condensers.

6. An ignition system for a multi-cylinder internal combustion engine as set forth in claim 1, wherein each ignition coil is disposed within a housing of an ignition plug unit.

7. An ignition system for a multi-cylinder internal combustion engine as set forth in claim 1, wherein each ignition plug is in a unit which comprises:

(a) a housing;

(b) a central electrode fixed at the center of said housing by fireproof insulating material;

(c) a ground electrode attached to said housing to form a spark gap cooperating with said cental electrode;

(d) a T-shaped iron bar;

(e) a straight iron bar connected to said T-shaped iron bar so as to form an I-shaped iron core;

(f) primary and secondary coils of a respective ignition coil wound around said I-shaped iron core, said coils and iron core being fixed at the center of said housing by fireproof insulating material in such a way that a high voltage terminal of said secondary ignition coil is adjacent the central electrode of said ignition plug; and (g) a cylindrical yoke arranged so as to cover said coil and to form a closed magnetic path in cooperation with said T-shaped and straight iron bars.

8. An ignition system for a multi-cylinder internal combustion engine as set forth in claim 7, wherein said cylindrical yoke is a part of the housing of said ignition plug.

9. An ignition system for a multi-cylinder internal combustion engine as set forth in claim 1, wherein said ignition coil is disposed within a housing of an ignition plug unit and includes means having a gap formed in a closed magnetic path to prevent magnetic saturation.

10. An ignition system for a multi-cylinder internal combustion engine, which comprises:

(a) crank angle sensor means for detecting crank angles and generating a plurality of crank angle signals corresponding thereto;

(b) load sensor means for detecting intake air flow rate of the engine and generating engine load signals Q corresponding thereto;

(c) engine speed sensor means for detecting engine speed and generating engine speed signals N corresponding thereto;

(d) booster means connected to a power supply for boosting a supply voltage of the power supply and deriving a boosted supply voltage corresponding thereto;

(e) ignition advance-angle/energy control means for storing reference ignition advance-angle values A and reference condenser charging-up voltage values Vn both corresponding to engine load and engine speed, reading the detected engine load signal Q and engine speed $N_1$, determining appropriate reference ignition advance-angle values A and reference condenser charging-up voltage values Vn corresponding to the detected engine load and engine speed in table look-up method, comparing a crank angle position detected by said crank angle sensor means with the determined reference ignition advance-angle values A, generating ignition signal e when the detected crank angle position d matches the reference advance-angle value A, comparing a voltage $V_{IN}$ derived from said booster means with the determined condenser charging-up voltage Vn, and supplying a control signal O to said booster means to stop oscillation of said booster means when the voltage $V_{IN}$ matches the voltage Vn;

(f) ignition means including switching means and ignition energy condensers for: (1) distributing the ignition signals e on the basis of the crank angle signal to plural separate circuits, (2) generating switching control signals in response to the distributed ignition signals e and one of the crank angle signals, (3) firing the switching means in response to the switching control signals, (4) directly charging ignition energy from said booster means into said ignition energy condensers, and (5) discharging the charged ignition energy through the switching means in response to the switching control signal;

(g) each of the plural circuits including an ignition coil for generating high-voltage when the charged ignition energy is discharged through said switching means; and (h) a plurality of ignition plugs for generating a spark in response to the high voltage.

11. Apparatus for controlling sparking of plural ignition plugs 1, 2 . . . N of an N cylinder internal combustion engine in response to a DC power source and signals indicative of engine crank angle, engine load and engine speed, where N is an integer greater than one, comprising means responsive to the engine crank angle, engine load and engine speed signals for deriving (a) N pulses having occurrence times indicative of desired spark advance angle for the N plugs and (b) a signal having a magnitude indicative of the desired energy in the spark for the plugs, the desired energy signal being responsive to the engine load and engine speed signals, N separate spark generating networks for converting energy from the DC power source into spark pulses to be sequentially supplied to the N ignition plugs, network K being responsive to desired occurrence time pulse K and the desired energy magnitude indicating signal for deriving the spark pulse for plug K at a time determined by the occurrence time of desired occurrence time pulse K and for causing the amount of energy in the spark pulse supplied to plug K to be equal to the energy indicated by the desired energy indicating signal, where K is selectively 1 . . . N.

12. The apparatus of claim 11 wherein network K includes an ignition coil, an energy storing capacitor, and a circuit for charging and discharging said capacitor; said coil, capacitor and circuit being connected to each other, the DC power source, and the means for deriving the desired occurrence time pulses and the desired energy indicating signal so that the capacitor is charged by the DC power source to a voltage controlled by the energy indicating signal at a time controlled by the desired occurrence time of the pulse and is then discharged through the coil.

13. The apparatus of claim 12 further including means for preventing charging of the capacitor of network K by the DC power source while the capacitor is discharging through the coil.

14. The apparatus of claim 12 wherein the DC power source includes a DC voltage booster having an output voltage controlled in amplitude in response to the desired energy magnitude indicating signal.

15. The apparatus of claim 14 wherein the DC power source includes a normally free running oscillator that is deactivated in response to a comparison of the magnitude of the desired energy magnitude indicating signal and a signal indicative of a DC voltage level supplied by the DC power source to the plug networks, the oscillator driving a rectifier having a filter capacitor, whereby a DC voltage level supplied to plug network K is developed across the filter capacitor.

16. The apparatus of claim 15 further including means for deactivating the oscillator while the capacitor of network K is discharging through the plug of network K.

17. The apparatus of claim 12 wherein the ignition coil of network K is mounted on ignition plug K.

18. The apparatus of claim 11 wherein the DC power source includes a normally free running oscillator that is deactivated while the capacitor is discharging to prevent charging of the capacitor of network K by the DC power source while the capacitor is discharging through the coil.

19. The apparatus of claim 11 further including transducer means coupled to the engine and responsive to engine operating parameters for deriving the signals indicative of engine crank angle, engine load and engine speed.

20. The apparatus of claim 11 wherein the DC power source includes a DC voltage booster having an output voltage controlled in amplitude in response to the desired energy magnitude indicating signal.

21. The apparatus of claim 20 wherein the DC power source includes a normally free running oscillator that is deactivated in response to a comparison of the magnitude of the desired energy magnitude indicating signal and a signal indicative of a DC voltage level supplied by the DC power source to the plug networks, the oscillator driving a rectifier having a filter capacitor, whereby a DC voltage level supplied to plug network K is developed across the filter capacitor.

22. The apparatus of claim 11 further including means for varying the magnitude of the desired energy indicating signal.

23. The apparatus of claim 22 wherein the means for varying includes means for increasing the magnitude of the desired energy indicating signal in response to an indication of at least one of: the engine being started, the engine idling, and the engine operating with a lean mixture under steady state operation.

24. The apparatus of claim 11 wherein network K includes an ignition coil mounted on ignition plug K.

25. The apparatus of claim 11 further comprising an engine knocking sensor for controlling the occurrence times of the N desired spark advance angle pulses so as to reduce knocking.

* * * * *